US012564244B2

(12) United States Patent
Rüegg et al.

(10) Patent No.: US 12,564,244 B2
(45) Date of Patent: Mar. 3, 2026

(54) SOLE WITH HORIZONTAL AND VERTICAL DAMPING FUNCTION

(71) Applicant: ON CLOUDS GMBH, Zürich (CH)

(72) Inventors: Martin Rüegg, Zürich (CH); Nils Altrogge, Zürich (CH); Johannes Voelchert, Zürich (CH)

(73) Assignee: ON CLOUDS GMBH, Zurich (CH)

( * ) Notice: Subject to any disclaimer, the term of this patent is extended or adjusted under 35 U.S.C. 154(b) by 0 days.

(21) Appl. No.: 18/273,617

(22) PCT Filed: Jan. 13, 2022

(86) PCT No.: PCT/EP2022/050649

§ 371 (c)(1),
(2) Date: Jul. 21, 2023

(87) PCT Pub. No.: WO2022/161786

PCT Pub. Date: Aug. 4, 2022

(65) Prior Publication Data

US 2024/0298744 A1 Sep. 12, 2024

(30) Foreign Application Priority Data

Jan. 29, 2021 (CH) ..... 0008921

(51) Int. Cl.
*A43B 13/18* (2006.01)

(52) U.S. Cl.
CPC ..... *A43B 13/181* (2013.01); *A43B 13/188* (2013.01)

(58) Field of Classification Search
CPC ..... A43B 13/18; A43B 13/181; A43B 13/206; A43B 7/08; A43B 7/088; A43B 7/10; A43B 13/188; A43B 13/125
See application file for complete search history.

(56) References Cited

U.S. PATENT DOCUMENTS 4,638,577 A 1/1987 Riggs
4,813,160 A * 3/1989 Kuznetz ..... A43B 7/088 36/3 R (Continued)

FOREIGN PATENT DOCUMENTS

CH 715 590 A1 5/2020
CN 2543378 Y 4/2003

(Continued)

OTHER PUBLICATIONS

EPO (Rijswijk, NL), English language version of the International Search Report, Form PCT/ISA/210, for International Application PCT/EP2022/050649, Apr. 21, 2022 (2 pages).

(Continued)

*Primary Examiner* — Patrick J. Lynch
*Assistant Examiner* — Brianna T. Duckworth
(74) *Attorney, Agent, or Firm* — Pauley Erickson & Swanson

(57) ABSTRACT

A sole for a running shoe having an elastic midsole, the midsole having a plurality of channels extending in the transverse direction of the midsole and arranged one behind the other in the longitudinal direction of the midsole, at least some of the channels each including an opening on the lateral side and/or on the medial side in the midsole; a front boundary and a rear boundary in the cross section along a cross sectional plane in the longitudinal direction of the midsole and perpendicularly to the transverse direction of the midsole, as well as a main longitudinal axis, along which the channels in each case extend in a slot-like manner from their respective rear boundary to their respective front boundary in such a way that the lateral-side and/or medial-side opening of the channels narrows along the main longitudinal axis from the rear boundary to the front boundary.

18 Claims, 4 Drawing Sheets

(56) References Cited

U.S. PATENT DOCUMENTS

| | | | | |
|---|---|---|---|---|
| 6,675,500 | B1 | 1/2004 | Cadamuro | |
| D532,597 | S * | 11/2006 | Chan | D2/977 |
| D532,598 | S * | 11/2006 | Chan | D2/977 |
| D616,188 | S * | 5/2010 | Chan | D2/977 |
| D811,701 | S * | 3/2018 | Tæstensen | D2/907 |
| D887,689 | S * | 6/2020 | Bove | D2/947 |
| 2006/0201028 | A1* | 9/2006 | Chan | A43B 13/141 36/28 |
| 2008/0163511 | A1* | 7/2008 | Dean | A43B 21/26 36/35 R |
| 2008/0289224 | A1* | 11/2008 | Sink | A43B 13/181 36/114 |
| 2010/0223810 | A1* | 9/2010 | Lekhtman | A43B 13/181 36/27 |
| 2012/0017444 | A1 | 1/2012 | Ireland et al. | |
| 2014/0250720 | A1 | 9/2014 | Miner et al. | |
| 2016/0183632 | A1 | 6/2016 | Scofiled et al. | |
| 2017/0000213 | A1 | 1/2017 | Mason et al. | |
| 2017/0367438 | A1 | 12/2017 | Del Biondi et al. | |
| 2018/0289105 | A1 | 10/2018 | Hatfiled et al. | |
| 2019/0365032 | A1 | 12/2019 | Kendall et al. | |
| 2020/0253327 | A1 | 8/2020 | Fujita | |
| 2021/0112917 | A1* | 4/2021 | Bock | A43B 13/223 |
| 2024/0298745 | A1 | 9/2024 | Altrogge et al. | |

FOREIGN PATENT DOCUMENTS

| | | | |
|---|---|---|---|
| CN | 202760304 | U | 3/2013 |
| CN | 203841197 | U | 9/2014 |
| CN | 203873105 | U | 10/2014 |
| CN | 105411095 | A | 3/2016 |
| CN | 105433510 | A | 3/2016 |
| CN | 105476176 | A | 4/2016 |
| CN | 205125228 | U | 4/2016 |
| CN | 104824906 | B | 5/2016 |
| CN | 105768347 | A | 7/2016 |
| CN | 205848826 | U | 1/2017 |
| CN | 107772637 | A | 3/2018 |
| CN | 107969754 | A | 5/2018 |
| DE | 34 40 206 | A1 | 5/1985 |
| DE | 698 09 474 | T2 | 8/2003 |
| DE | 20 2004 012 472 | U1 | 10/2004 |
| DE | 695 33 837 | T2 | 4/2005 |
| DE | 20 2005 007 867 | U1 | 8/2005 |
| DE | 10 2009 054 617 | A1 | 6/2011 |
| DE | 10 2010 055 727 | A1 | 6/2011 |
| DE | 20 2014 003 016 | U1 | 4/2014 |
| EP | 0 189 642 | A1 | 8/1986 |
| EP | 1 447 020 | A1 | 8/2004 |
| EP | 1 824 353 | A1 | 8/2007 |
| EP | 2 700 325 | A1 | 2/2014 |
| EP | 3 117 732 | A1 | 1/2017 |
| EP | 3 379 963 | A1 | 10/2018 |
| EP | 3 484 320 | A1 | 5/2019 |
| EP | 3 648 628 | A1 | 5/2020 |
| ES | 2 354 142 | A1 | 3/2011 |
| FR | 2 695 809 | A1 | 3/1994 |
| GB | 2554949 | A | 4/2018 |
| JP | H07-100002 | A | 4/1995 |
| JP | 2005-218543 | A | 8/2005 |
| KR | 10-0584527 | B1 | 5/2006 |
| KR | 10-2009-0124479 | A | 12/2009 |
| KR | 10-2010-0125083 | A | 11/2010 |
| KR | 10-2012-0083654 | A | 7/2012 |
| WO | WO 2006/065047 | A1 | 6/2006 |
| WO | WO 2016/184920 | A1 | 11/2016 |
| WO | WO 2017/089406 | A1 | 6/2017 |
| WO | WO 2017/145131 | A1 | 8/2017 |
| WO | WO 2018/011030 | A1 | 1/2018 |
| WO | WO 2019/008453 | A1 | 1/2019 |
| WO | WO 2019/214814 | A1 | 11/2019 |
| WO | WO 2022/161785 | A1 | 8/2022 |
| WO | WO 2022/161786 | A1 | 8/2022 |

OTHER PUBLICATIONS

Hope, A., "Adidas Climacool Seduction—New Colorways," Sneaker News, (2016) May 20, https://sneakernews.com/2012/03/29/adidas-climacool-seduction (12 pp.).

Betschart, B., "Climacool Seduction-officially unvelied," Sneaker Files—Latest Sneaker News, Release Dates, Where to Buy, May 23, 2016, https://www.sneakerfiles.com/adidas -climacool-seduction-officially-unveiled (12 pp.).

* cited by examiner

SOLE WITH HORIZONTAL AND VERTICAL DAMPING FUNCTION

BACKGROUND OF THE INVENTION

Cross Reference to Related Application

This application is a National Phase filing in the United States, under 35 USC § 371, of PCT International Patent Application PCT/EP2022/050649, filed on 13 Jan. 2022 which claims the priority of Swiss Patent Application CH 00089/21, filed 29 Jan. 2021. The above-referenced applications are hereby incorporated by reference herein in their entirety and are made a part hereof, including but not limited to those portions which specifically appear hereinafter.

Field of the Invention

The present invention relates to the field of footwear technology, in particular to a sole for a running shoe.

Discussion of Related Art

A plurality of running shoes with different cushioning systems is known in the prior art. Sports and leisure shoes with soles, which have a gel core in the heel area to ensure a vertical cushioning when treading are widespread. Improvements to the vertical cushioning properties were furthermore attained in that individual spring elements were attached in the heel area between outsole and insole.

Even though the vertical cushioning properties of the shoes is improved by means of the above-mentioned soles, a satisfactory cushioning of forces acting horizontally on the sole and the shoe cannot be attained. Forces with a large horizontal component are additionally reinforced in particular on far-off routes and represent one of the main causes for frequently occurring knee and hip joint pain due to a lack of sufficient cushioning.

A sole is known from WO 2016 184 920 by the applicant, which has segmented and groove-shaped elements, which protrude downwards and are open on the side. Under the effect of the forces occurring when running, the groove-shaped elements are vertically as well as horizontally deformable until their lateral openings are closed. Due to this horizontal deformability, forces acting horizontally on the sole and the shoe, for example when running on sloping terrain, can also be cushioned efficiently, and a high load on the joints, in particular the knees and the hip, can be avoided thereby.

SUMMARY OF THE INVENTION

In the case of soles comprising segmented, groove-shaped elements, which protrude downwards and are open on the side, fatigue of the material can occur in the case of longer usage time depending on the used sole material, so that cushioning decreases on the one hand and the lateral openings of the groove-shaped elements are irreversibly deformed on the other hand because the elastic properties of the material can get lost after longer usage time. In the case of the sole known from WO 2016 184 920, the groove-shaped elements are furthermore in each case present as individual elements, which protrude from the sole. Depending on weight and foot position of the wearer, this can result in an irregular closure of the lateral openings, whereby the wearer can experience a floating effect because the respective upper and lower layers of the groove-shaped element do not come to rest on one another exactly, but can be spatially shifted relative to one another, for example in the transverse direction of the sole, thus perpendicularly to the longitudinal direction or running direction, respectively.

The present invention is based on the general problem of further developing the prior art in the area of running shoe soles and to preferably completely or partially overcome the disadvantages of the prior art. In advantageous embodiments, a sole which, on the one hand, can cushion forces acting horizontally on the sole and the shoe when running but which, on the other hand, does not show any or at least lower fatigue of the material even in the case of a longer usage time, is provided. The occurrence of a floating effect is avoided in further advantageous embodiments. In some advantageous embodiments, the cushioning effect in the heel area is increased compared to the prior art, while compared to heel area a lower cushioning effect is provided in the forefoot area, so that significantly less force gets lost when pushing off, and said force is available virtually completely for the process of pushing off.

The general problem is solved by means of a sole according to the independent claim. Further advantageous embodiments follow from the dependent claims as well as the description and the drawings.

In a first aspect, the general technical problem is solved by means of a sole for a running shoe comprising an elastic midsole. The midsole thereby has several channels, which extend in the transverse direction of the midsole and which are arranged one behind the other in the longitudinal direction of the midsole. The channels, in particular all channels, or at least a portion of the channels (so-called channels of the first type) thereby each comprise:

- a lateral-side and/or medial-side opening in the midsole; and additionally, each comprise;
- a front boundary and a rear boundary in the cross section along a cross sectional plane in the longitudinal direction of the midsole and perpendicularly to the transverse direction of the midsole, as well as a main longitudinal axis. Along their respective main longitudinal axis, the channels in each case extend in a slot-like manner from their respective rear boundary to their respective front boundary in such a way that the lateral-side and/or medial-side opening of the channels narrows along the main longitudinal axis of the respective channel from the rear boundary to the front boundary.

Channels arranged in this way have the advantage that due to the narrowing of the channel opening along the main longitudinal axis of the respective channel from the rear boundary towards the front boundary, forces, which act vertically as well as horizontally and which occur when running can be cushioned efficiently due to the narrowing of the opening. The channels are typically delimited completely in the lateral and in the medial area of the midsole, i.e., at least on the lateral side and/or on the medial side, by the soft elastic midsole. In the cross section along a cross sectional plane in the longitudinal direction (L) of the midsole and perpendicularly to the transverse direction (Q) of the midsole, the channels are in particular delimited completely by the midsole. In such an embodiment, the channel walls can thus be formed completely by the midsole in the lateral area of the midsole. In the side view of the sole, the channels can thus typically be described as transverse openings in an otherwise preferably one-piece midsole. In some embodiments, the midsole does not have a segmentation, is thus free from segmentation. The durability of the sole can be improved significantly thereby because, compared to a segmented midsole, the midsole is generally formed to be significantly more stable. A fatigue of the soft elastic midsole is furthermore avoided over the useful life of the sole or of the running shoe, respectively, or is at least significantly reduced. The advantageous cushioning effect of the midsole can thereby constantly be maintained over a long period of time.

The main longitudinal axis of a channel in each case extends parallel to the longitudinal direction of the channel, i.e., the direction in which the channel extends in a slot-shaped manner and extends through the center point of the channel in the cross section along the above-mentioned cross-sectional plane. The main longitudinal axis lies in the V,L plane of the midsole, i.e. it does not extend in the transverse direction of the midsole but in the longitudinal direction and/or in the vertical direction of the midsole. In some embodiments, the main longitudinal axis can extend through the points of the channel walls, which are farthest away from one another in the cross section along the above-mentioned cross-sectional plane. The channel walls of a channel can thus have a greater distance from one another along the main longitudinal axis of the channel than along any further axis in the V,L plane of the corresponding channel.

The person skilled in the art understands a slot-shaped channel to be a channel, which has an elongated narrow contour in the cross section along the cross-sectional plane in the longitudinal direction of the midsole and perpendicularly to the transverse direction of the midsole, and thus provides an elongated narrow opening in the midsole. The width of such a channel is thus greater than its height. The expansion of such a channel along a spatial direction is thus greater than along a spatial direction, which differs therefrom, within the same spatial plane, in particular in the V,L plane. A channel, which has the shape of a square or of a regular circle in the cross section is thus not slot-shaped.

The front and rear boundary of the channel in each case delimits the channel along the main longitudinal axis on its front-end area, i.e., facing the sole tip, and on its rear end area, i.e. facing the heel edge. From the heel edge in the longitudinal direction to the sole tip, the front-end area of a channel is thus arranged upstream of the rear end area. This does not mean, however, that the main longitudinal axis of a channel of this type must mandatorily extend parallel to the base surface of the midsole, or in the worn state parallel to the ground, respectively. Even though this is possible, it is preferred that the main longitudinal axis of one or of several channels to the base surface or, in the worn state to the ground, respectively, has an angle of >0° to <90°, in particular of 5° to 80°. The front and rear boundary can thereby be formed, for example, to be curved in the cross section along the cross-sectional plane, i.e., in a curve-shaped manner. They are thereby in each case formed concavely towards the channel center or to the channel center point, respectively.

In some embodiments, the channels, in particular all channels, of the midsole can generally extend in the cross section along the longitudinal direction and perpendicularly to the transverse direction of the midsole, from their respective end arranged closest to the heel edge, or the rear end area, respectively, in the longitudinal direction towards their respective end arranged closest to the sole tip, or the front end area, respectively, so as to increase in the vertical direction or parallel to the longitudinal direction. In other words, none of the channels of the midsole in the cross section along the longitudinal direction and perpendicularly to the transverse direction of the midsole preferably extends so as to decrease in the vertical direction from its respective end arranged closest to the heel edge, or the rear end area, respectively, in the longitudinal direction towards its respective end arranged closest to the sole tip, or the front end area, respectively. The main longitudinal axis of the respective channels, in particular of all of the channels of the midsole, thus increases in the vertical direction or is parallel to the longitudinal direction from the heel edge towards the sole tip. The main longitudinal axis of the respective channels, however, does not decrease in the vertical direction from the heel edge towards the sole tip.

The channels are typically formed in such a way that the lateral-side and/or medial-side opening of the channels narrows along the main longitudinal axis from the rear boundary towards the front boundary over a majority of the channel along the main longitudinal axis, in particular over at least 30%, in particular over at least 50%, in particular over at least 70%, in particular over at least 90%, of the total width of the channel in the cross section along the longitudinal direction and perpendicularly to the transverse direction along the main longitudinal axis.

In some embodiments, the channels are configured such that the channels assume an S-shape upon complete closure, in particular in response to the complete closure of the lateral openings.

The channels of the midsole are typically arranged at least in the heel area and optionally in the midfoot area and/or in the forefoot area of the sole. In some embodiments, the channels are arranged in the heel area, in the midfoot area, and in the forefoot area.

Directional indications, as used in the present disclosure, are to be understood as follows: The longitudinal direction L of the sole is described by an axis from the heel area to the forefoot area and thus extends along the longitudinal axis of the sole. The transverse direction Q of the sole extends transversely, i.e., perpendicularly to the longitudinal axis and essentially parallel to the underside of the sole or essentially parallel to the ground, respectively. The transverse direction thus extends along a transverse axis of the midsole. In connection with the present invention, the vertical direction or vertical direction V identifies a direction from the underside or the base surface of the sole, respectively, in the direction of the insole as well as the top surface or, in the operative state, in the direction of the foot of the wearer, respectively, and thus extends along a vertical axis of the midsole. The lateral side of the sole is the external outer delimitation of the sole, which, in the worn state, abuts against the outside of the foot of the wearer. The medial side of the sole or of the midsole, respectively, refers to the external inner delimitation of the sole, which is arranged opposite to the lateral side. In the case of a pair of running shoes, the medial sides of the two running shoes thus face one another and the lateral sides face away from one another in the worn state.

The midsole can typically be divided in the longitudinal direction, i.e., in the worn state along the running direction, into a heel area, a forefoot area, and a midfoot area, which is arranged directly between the heel area and the forefoot area. The forefoot area extends, for example, in the longitudinal direction from the sole tip opposite to the longitudinal direction up to 30-45% of the total length of the midsole. The heel area extends, for example, in the longitudinal direction from the heel edge in the longitudinal direction up to 20-30% of the total length of the midsole. The midfoot area thereby extends directly between the heel area and the forefoot area, so that the length in the longitudinal direction of the midfoot area accounts for the remaining portion of the total length, in particular of 15-50% of the total length.

The midsole can typically have a base surface delimiting the midsole opposite to the vertical direction of the midsole, and a top surface delimiting the midsole in the vertical direction. It is understood that when running, i.e., in the operative state, the base surface faces the ground, and the top surface faces the foot of the wearer or the insole, respectively.

A sole according to the present invention can consist of the midsole or can only comprise the latter. In the latter case, a sole according to the invention can comprise further components, such as, e.g., an insole and/or an outer sole made of a wear-resistant and/or profiled material, in some embodiments.

Elastic, in particular soft elastic materials for soles are well known to the person skilled in the art. For example, materials with a Young's modulus of approximately 0.0001 to 0.2 GPa, in particular 0.001 to 0.1 GPa can be used, which, in terms of the present invention, can be considered to be elastic or soft elastic material, respectively. Such materials can typically comprise polymer foams. Polyolefins, polyolefin block polymers, polyvinyl acetates, in particular EVA, polyurethane, in particular thermoplastic polyurethane (TPU), or expanded thermoplastic polyurethane (eTPU), polyamides, e.g. PA-11, PA-12, nylon, polyether block amide (PEBAX®), polyethylene terephthalate (PET) or polybutylene terephthalate (PBT) or mixtures thereof can be used as elastic or as soft elastic materials, respectively.

In terms of the present invention, a channel is to be understood to be a recess, which can typically be formed in a tube-shaped manner. Except for at the lateral openings, a channel is generally delimited completely or partially by its channel walls. The channels are typically empty. The channels can in particular be open and continuous, i.e., a channel is preferably not a blind hole. A channel, in particular all of the channels of the midsole, preferably extend continuously from the lateral side of the midsole to the medial side of the midsole. In preferred embodiments, the channels can extend essentially parallel to one another. In some embodiments, the total portion of the open area of the midsole, i.e., the total portion of the lateral surfaces of the channel openings, can be smaller than the total portion of the closed surface of the midsole, i.e., the total portion of the outer surface of the midsole, which does not have any channels. In some embodiments, the channels are arranged one behind the other only in the longitudinal direction, thus from the heel edge towards the sole tip. This does not exclude that some or also all channels can be arranged offset from one another in the vertical direction. Preferably, no channels are arranged completely and/or partially one on top of the other in the vertical direction.

In some embodiments, the channels are arranged one behind the other in the longitudinal direction from the heel edge to the sole tip of the sole, and at least two or more channels are arranged offset from one another in the vertical direction. In certain embodiments, the channels are arranged in at least a first and a second horizontal plane in the lateral and/or medial area of the midsole. The first and second horizontal plane are thereby formed to be offset vertically from one another. By means of the arrangement of the channels in at least a first and a second horizontal plane, a significant improvement of the cushioning effect is attained. The cushioning is thereby additionally no longer limited to individual segments of the sole but extends essentially over the entire midsole.

A horizontal plane of the sole describes a plane, which is aligned essentially parallel to the underside of the sole or essentially parallel to the ground, respectively. It is understood that the horizontal plane can also be slightly curved. This can be the case, for example, when the sole is slightly curved vertically upwards at the forefoot area and/or at the heel area, as is typical for running shoes.

It is clear to the person skilled in the art that the deformability of the channels can comprise, for example, vertically bringing together the channel walls and/or shearing of the channel in the longitudinal direction. The upper and the lower channel wall can typically touch one another under the effect of the forces occurring when running, so that the corresponding channel is deformed until lateral closure.

In a preferred embodiment, the elastic midsole is formed in one piece. The elastic midsole thus preferably consists of a single material and is thus more stable than a midsole consisting of several components, in particular components, which are glued or welded to one another.

In a preferred embodiment, the channels have lateral openings on the lateral side and the medial side of the midsole. The channels can preferably be deformed vertically and/or horizontally in the longitudinal direction under the effect of forces, which act vertically and/or in the longitudinal direction and which occur when running. These openings can close by means of the forces occurring when running, in particular close completely, in that the channel walls of a cannel touch. The channels arranged in the heel area and/or in the midfoot area and/or in the forefoot area can thus be designed to completely close the lateral openings by means of the forces occurring when running. The forces occurring when running are typically attributed to the weight force based on the weight of the wearer, which can be, for example, between 40 and 120 kg, in particular between 50 and 100 kg.

The upper and the lower channel wall can typically touch one another under the effect of the forces occurring when running.

In some embodiments, the channels are arranged in such a way that the respective main longitudinal axis of the channels has a component in the vertical direction of the midsole and a component in the longitudinal direction. Slot-shaped channels of this type as well as the corresponding main longitudinal axes thereof thus extend in the longitudinal direction towards the sole tip as well as in the vertical direction in the direction of the top surface of the midsole, in the side view of the sole or in the cross section along the cross sectional plane in the longitudinal direction of the midsole and perpendicularly to the transverse direction of the midsole, viewed from the base surface of the midsole, respectively. Such embodiments have the advantage that due to the special arrangement of the channels, combined with the opening, which narrows towards the front boundary of the channel, in particular forces, which act horizontally and occur when running, can be cushioned efficiently because the shearing of the channel walls is facilitated, so that it is possible that the lateral openings close virtually completely under shearing.

In some embodiments, the channels are formed essentially mirror-symmetrically to their main longitudinal axis, in each case along the cross-sectional plane in the longitudinal direction of the midsole) and perpendicularly to the transverse direction of the midsole or in the side view of the midsole, respectively. It is attained thereby that no floating effect occurs when closing the openings or that said floating effect is reduced significantly, respectively, because the channel walls come to rest exactly one on top of the other. A stable stand of the wearer is achieved thereby.

In some embodiments, the channels each have two flanks, which are located opposite one another and which extend towards one another along the main longitudinal axis. The flanks can thereby typically extend essentially linearly from the rear boundary to the front boundary in the cross section along the above-mentioned cross-sectional plane, wherein the flanks thereby continuously approach the main longitudinal axis.

In some embodiments, the midsole has a base surface delimiting the midsole opposite to the vertical direction of the midsole, and a top surface delimiting the midsole in the vertical direction. The main longitudinal axis of the respective channels is thereby arranged in such a way that it intersects the base surface and/or a tangent abutting against it (if the base surface is not a flat surface but is formed to be curved in the vertical direction, in particular in the area of the sole tip and/or of the heel edge, i.e., formed convexly with respect to the ground in the worn state; the person skilled in the art understands that the tangent is applied to the point of intersection between the base surface and the main longitudinal axis) at an angle of 5° to 85°, in particular of 30° to 85°, in particular of 40° to 75°. The larger the corresponding angle, the more efficiently horizontally acting forces can be absorbed. Smaller angles are to be preferred thereby in the midfoot area because, on the one hand, a cushioning, which is not as high as in the heel area, is necessary at the point where the first contact typically takes place when running and, on the other hand, a cushioning entails an energy loss when pushing off, which typically takes place in the forefoot and in the midfoot area because the cushioning first absorbs a portion of the push-off force. In the heel area, in contrast, angles of 30° and more are to be preferred because a high cushioning is required in this area, and the heel area is not involved directly in the push-off process when running.

The feature of the acute angle between the main longitudinal axis of a channel and the base surface of the midsole can additionally be replaced by the obtuse angle between the main longitudinal axis of the respective channel and the perpendicular channel line through the center point of the respective channel. The perpendicular channel line therefore extends through the center point of the channel and is perpendicular to the base surface of the midsole or intersects the latter essentially at an angle of 90°, respectively. In this case, the obtuse angle between the main longitudinal axis and the respective perpendicular channel line of at least one channel arranged in the heel area is thereby also greater than the obtuse angle between the respective perpendicular channel line and the main longitudinal axis of at least one channel arranged in the midfoot area and/or in the forefoot area. In the case of all of the embodiments described here, the feature of the acute angle between the main longitudinal axis of a channel and the base surface of the midsole can thus be replaced by the feature of the obtuse angle between the main longitudinal axis of the respective channel and the perpendicular channel line of the respective channel. In some embodiments, the obtuse angle between the main longitudinal axis and the respective perpendicular channel line of at least one channel arranged in the forefoot area, in particular of all of the channels arranged in the forefoot area, is between 90° to 175°, in particular 90° to 165°. The person skilled in the art understands that an obtuse angle is between 90° and 180° and an acute angle is between 0° and 90°.

In some embodiments, the channels each have a pentagonal, hexagonal and/or drop-shaped, in particular lancet-shaped contour, along the cross-sectional plane in the longitudinal direction of the midsole and perpendicularly to the transverse direction of the midsole. It is also possible thereby that one or several channels of the midsole have a different contour than further channels of the midsole. The midsole can in particular have up to five channels with different contour. A drop-shaped contour refers to a shape, which is essentially characterized of an isosceles triangle and a circular segment connected thereto. The person skilled in the art understands that these contours also include shapes with rounded corners, e.g., a rectangle with rounded corners. A drop-shaped contour is particularly preferred thereby, in particular when the portion of the circular segment of the drop shape is aligned towards the base surface. This is so because a particularly large horizontal cushioning of forces acting in the horizontal direction when running can be achieved thereby. A drop-shaped contour furthermore allows for a particularly controlled closure of the channels, so that a floating effect is avoided. The reason for this is that in particular channels with a drop-shaped contour are configured to assume an S-shape upon closure. It thus is understood that channels with a drop-shaped contour are arranged in particular in the heel area. In contrast, channels with a different contour along the cross-sectional plane in the longitudinal direction of the midsole and perpendicularly to the transverse direction of the midsole, in particular a rectangular, pentagonal and/or hexagonal contour, can thereby be provided in the forefoot area and/or in the midfoot area.

In some embodiments, at least a portion of the or also all channels are configured to completely close their lateral opening by means of the forces occurring when running. On the one hand, a good cushioning is attained thereby by means of the collapsing of the channels when treading, but, on the other hand, a secure stand is made possible at the moment of the maximum load by means of the complete closure because further displacements in the transverse and/or in the longitudinal direction are prevented due to the closure.

In some embodiments, the midsole is divided into a heel area, a forefoot area, and a midfoot area arranged between the heel area and the forefoot area. The channels, which are described in the above embodiments, are thereby arranged at least in the heel area and/or in the midfoot area. These channels are preferably arranged at least in the heal area because the largest load acts in this area when treading.

In some embodiments, the main longitudinal axis of a channel intersects the base surface or a tangent abutting against the point of intersection of the main longitudinal axis and the base surface, respectively, at an acute angle. The acute angle between the main longitudinal axis and the base surface or the corresponding tangent, respectively, of at least one channel arranged in the heel area is thereby greater than the acute angle between the base surface and the main longitudinal axis of at least one channel arranged in the midfoot area and/or in the forefoot area. It has been shown that a significantly increased cushioning effect can be attained in the heel area due to the elongated contour of the channel and due to the fact that the acute angle between the base surface and the main longitudinal axis of at least one channel is greater in the heel area than in the case of a channel in the midfoot area and/or in the forefoot area, while a lower cushioning effect is attained in the forefoot area and/or in the midfoot area due to the smaller acute angles between the base surface and the main longitudinal axis, which has the effect that when pushing off, which virtually takes place completely via the forefoot area and optionally the midfoot area, hardly any energy gets lost due to the cushioning. The increased acute angle of the channel or of the channels, respectively, in the heel area furthermore has the effect that not only a vertical cushioning is attained, but also a large horizontal cushioning of the forces, which act horizontally when running. All channels in the heel area of the midsole preferably have a greater acute angle between the base surface and the respective main longitudinal axis thereof than all channels in the forefoot area and/or in the midfoot area.

The feature of the acute angle between the main longitudinal axis of a channel and the base surface of the midsole can additionally be replaced by the obtuse angle between the main longitudinal axis of the respective channel and the perpendicular channel line through the center point of the respective channel. The perpendicular channel line therefore extends through the center point of the channel and is perpendicular to the base surface of the midsole or intersects the latter essentially at an angle of 90°, respectively. The center point of the channel generally lies on the main longitudinal axis. In this case, the obtuse angle between the main longitudinal axis and the respective perpendicular channel line of at least one channel arranged in the heel area is thereby also greater than the obtuse angle between the respective perpendicular channel line and the main longitudinal axis of at least one channel arranged in the midfoot area and/or in the forefoot area.

In some embodiments, the acute angle between the main longitudinal axis and the base surface of a channel arranged in the heel area, in particular of all of the channels arranged in the heel area, is between 35° and 85°, in particular between 40° and 75°. Due to the relatively large angle, not only a good vertical cushioning is attained, but also a large horizontal cushioning because the channels can be closed by means of the forces acting horizontally when running, in particular by contacting the channel walls of a channel.

In some embodiments, the obtuse angle between the main longitudinal axis and the respective perpendicular channel line of a channel arranged in the heel area, in particular of all of the channels arranged in the heel area, is between 110° and 175°, in particular between 125° and 170°, preferably between 125° and 165°. Due to the relatively large angle, not only a good vertical cushioning is attained, but also a large horizontal cushioning because the channels can be closed by means of the forces acting horizontally when running, in particular by contacting the channel walls of a channel.

In some embodiments, the acute angle between the main longitudinal axis and the base surface or the obtuse angle between the main longitudinal axis and the respective perpendicular channel line, respectively, becomes smaller from the channel arranged closest to the heel edge of the midsole towards the sole tip, in particular continuously smaller at least over a subarea from the heel edge into the midfoot area. In the forefoot area, the acute angle can thereby be 0° throughout, i.e., the main longitudinal axis of the channels in the forefoot area is then parallel to the base surface. Viewed from channel to channel, the channels thereby decrease from the heel edge in the direction of the sole tip. It is attained thereby that an increased cushioning effect can be attained in the heel area, while a lower cushioning effect is attained due to the smaller acute angles between the base surface and the main longitudinal axis in the forefoot area and/or in the midfoot area, which has the effect that hardly any energy gets lost due to the cushioning when pushing off. It generally applies that the greater the acute angle between the main longitudinal axis of a channel and the base surface, the greater the cushioning effect. It is thus advantageous that the channel arranged closest to the heel edge has the greatest acute angle because the required cushioning effect is greatest here. The farther a channel is arranged towards the sole tip in the longitudinal direction, the smaller the required cushioning effect, so that the acute angle between the main longitudinal axis and the base surface is selected to be smaller.

In certain embodiments, the acute angle between the main longitudinal axis and the base surface or the obtuse angle between the main longitudinal axis and the respective perpendicular channel line, respectively, becomes continuously smaller from the channel arranged closest to the heel edge of the midsole in the direction of the sole tip in the heel area or also exclusively in the heel area.

In some embodiments, the midsole additionally has channels in the forefoot area, which have an essentially rectangular contour along the cross-sectional plane in the longitudinal direction of the midsole and perpendicularly to the transverse direction of the midsole. Compared to the previously described channels with lateral openings narrowing towards the front boundary, these channels can be described as channels of the second type, which differ from the above-described channels of the first type in that they do not have any narrowing lateral openings towards the front boundary. The midsole always has channels of the first type but can optionally additionally have channels of the second type. They are preferably arranged in the forefoot area because the cushioning effect in the case of channels of the second type is lower than in the case of channels of the first type. While a cushioning effect, which is to be as high as possible, is to be attained in the heel area, this is not desirable in the forefoot area because a lower cushioning effect compared to the heel area prevents that a significant portion of the force of the runner gets lost when pushing off and this force is thus available virtually completely for the pushing-off process.

In some embodiments, the acute angle between the main longitudinal axis and the base surface of at least one channel arranged in the forefoot area, in particular of all of the channels arranged in the forefoot area, is between 0° to 15°, in particular 0° to 5°, in particular 0° to 2°. An angle of 0° means that the main longitudinal axis of the channel and the base surface are arranged essentially parallel to one another. In the case of a curved base surface, this parallelism refers to a tangent abutting against the base surface, which abuts against the base surface below the channel in the vertical direction. Small angles of this type have the result that even though a sufficient cushioning is still provided on the one hand, so that the joints of the wearer are protected sufficiently, the cushioning is not too large, on the other hand, that a significant portion of the push-off energy gets lost due to the cushioning.

In some embodiments, the obtuse angle between the main longitudinal axis and the respective perpendicular channel line of at least one channel arranged in the forefoot area, in particular of all of the channels arranged in the forefoot area, is between 90° to 100°, in particular 90° to 95°. An obtuse angle of 90° means that the main longitudinal axis of the channel and the base surface are arranged essentially parallel to one another. In the case of a curved base surface, this parallelism refers to a tangent abutting against the base surface, which abuts against the base surface below the channel in the vertical direction.

In specific embodiments, the main longitudinal axis of at least one channel arranged in the forefoot area, in particular of all of the channels arranged in the forefoot area, is arranged essentially parallel to the base surface.

In some embodiments, the acute angle between the main longitudinal axis and the base surface of a channel arranged in the midfoot area is between 0° and 35°, preferably between 0° and 25°. The midfoot area represents an intermediate area, where a certain cushioning effect is still required when treading on the one hand, but the cushioning effect must not be too great on the other hand because in particular the front part of the midfoot area, viewed in the longitudinal direction towards the sole tip, is already used for pushing off the ground. The acute angle between the main longitudinal axis and the base surface of a channel, which connects directly to a channel in the heel area, is particularly preferably greater than 0°, for example between 10° and 35° or 10° to 25°. In certain embodiments, the acute angle between the main longitudinal axis and the base surface becomes continuously smaller from the channel arranged in the midfoot area of the heel edge of the midsole in the direction of the sole tip in the heel area.

In some embodiments, the obtuse angle between the main longitudinal axis and the respective perpendicular channel line of a channel arranged in the midfoot area is between 90° and 120°, preferably between 90° and 115°.

In some embodiments, each channel has a main lateral axis. The main lateral axis is thereby typically perpendicular to the respective main longitudinal axis of the channel and extends through the channel center point. As does the main longitudinal axis, the main lateral axis lies in the V,L plane, thus does not extend in the transverse direction. The height, i.e., the direct distances of the channel walls of a channel along the main lateral axis of a channel arranged in the forefoot area is thereby smaller than the height along the main lateral axis of a channel arranged in the midfoot area and/or in the heel area. A high cushioning effect is attained in the heel area thereby. At the same time, the cushioning effect in the forefoot area is significantly smaller, whereby less energy gets lost when pushing off.

In some embodiments, the channels each have a height of 0.1 cm to 1.5 cm, preferably of 0.1 cm to 1 cm, along the main lateral axis.

In some embodiments, the channels each have a width of 0.5 cm to 3 cm, preferably of 0.5 cm to 2 cm, along the main longitudinal axis. The width describes the distance of the channel walls of a channel along the main longitudinal axis and thus in some embodiments the greatest expansion in the cross-sectional plane along the longitudinal direction and transversely to the transverse direction of the sole.

In some embodiments, a portion of the channels, in particular all channels, of the midsole can in each case taper in the transverse direction from the lateral side towards the medial side of the midsole. The open area of such a channel thus becomes smaller in the cross section along a cross sectional plane along the longitudinal direction and perpendicularly to the transverse direction of the midsole from the lateral side in the transverse direction towards the medial side of the midsole. This has the advantage that the stability of the sole, in particular when treading, is increased, without the cushioning properties being decreased significantly. Additionally, or alternatively, a portion of the channels, in particular all channels, of the midsole can in each case taper in the transverse direction from the medial side towards the lateral side of the midsole. These two alternatives thereby support different running styles of the wearer, depending on whether the sole is loaded increasingly on the lateral side or on the medial side. It is also possible that, for example, the channels in the forefoot area in each case taper in the transverse direction from the lateral side towards the medial side of the midsole and that the channels in the heel area in each case taper in the transverse direction from the medial side towards the lateral side of the midsole, and vice versa. In addition, the channels in the midfoot area can in each case taper in the transverse direction from the lateral side towards the medial side of the midsole or can in each case taper in the transverse direction from the medial side towards the lateral side of the midsole.

A further aspect of the invention relates to a shoe, in particular a running shoe, comprising a sole according to one of the embodiments described here.

A further aspect of the invention relates to the use of a sole according to one of the embodiments described here for producing a shoe, in particular a running shoe.

BRIEF DESCRIPTION OF SEVERAL VIEWS OF THE DRAWINGS

Aspects of the invention will be described in more detail on the basis of the exemplary embodiments shown in the following figures and the corresponding description.

DETAILED DESCRIPTION OF THE INVENTION

Figure 1:
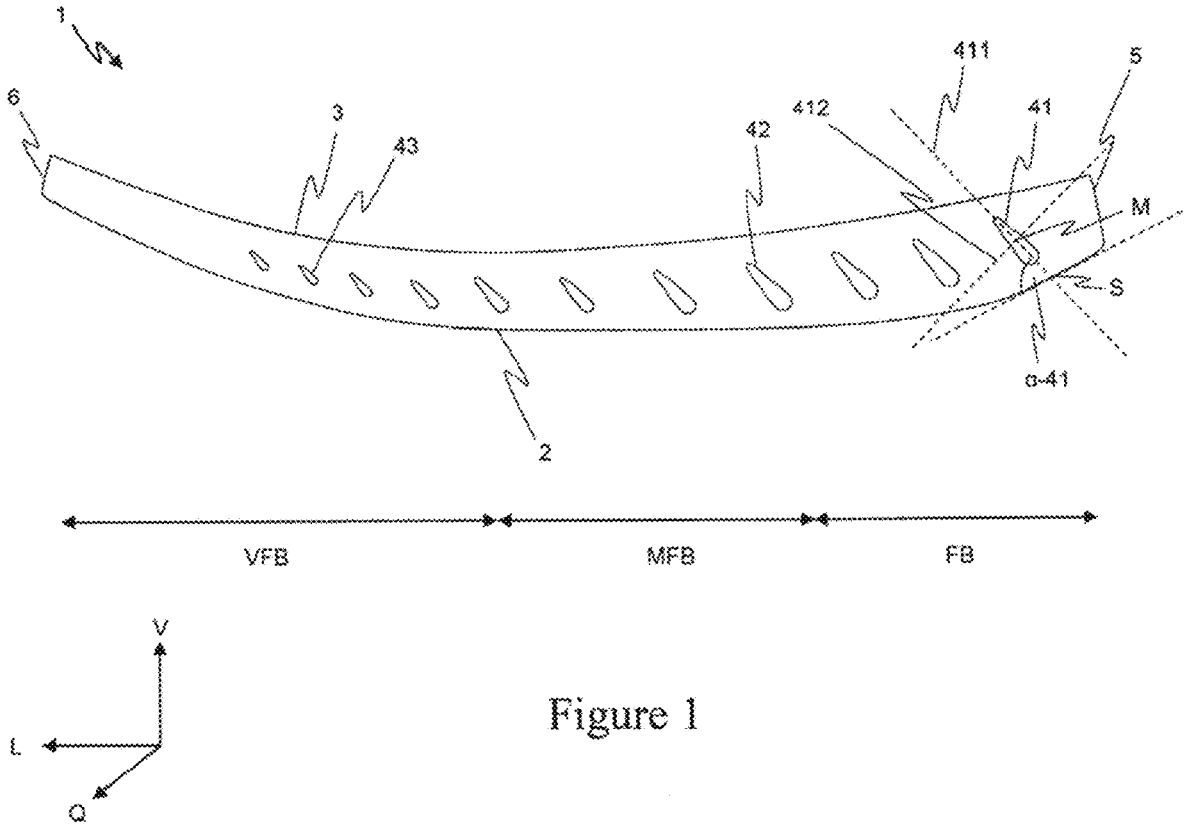
FIG. 1 shows a schematic side view of a sole according to the invention for a running shoe according to an embodiment of the invention.

A sole according to the invention for a running shoe is shown in FIG. 1, which has an elastic midsole 1. The midsole 1 is delimited opposite to the vertical direction V by the base surface 2 and in the vertical direction V by the top surface 3. The midsole 1 is additionally divided into a heel area FB, a midfoot area MFB, and a forefoot area VFB. As illustrated, these three areas are arranged one behind the other in the longitudinal direction, whereby the midfoot area MFB is arranged between the heel area FB and the forefoot area VFB. The midsole 1 comprises several channels 41, 42, 43 (for the sake of clarity, only three of the channels are identified), which extend in the transverse direction Q of the midsole 1 and which are arranged one behind the other in the longitudinal direction L of the midsole 1. In the transverse direction Q, these channels can generally be arranged essentially parallel to one another. The channels thereby each have a lateral-side and a medial-side opening in the midsole. The channels additionally each have a front boundary and a rear boundary (see FIGS. 2*a* and 2*b*) in the cross section along a cross sectional plane in the longitudinal direction L of the midsole 1 and perpendicularly to the transverse direction Q of the midsole 1, as well as a main longitudinal axis (411) (for the sake of clarity, only main longitudinal axis of channel 41 is illustrated). It can be seen thereby that the channel 41 in the above-mentioned cross sectional plane, the V,L plane, extends along the main longitudinal axis 411 from its rear boundary towards its front boundary in a slot-shaped manner in such a way that the lateral- and/or medial-side opening of the channel 41 along the main longitudinal axis 411 narrows from the rear boundary towards the front boundary. The main longitudinal axis 411 thereby extends through the center point M of the channel 41. The channel 41 is thereby arranged in such a way that its main longitudinal axis 411 extends in the longitudinal direction L as well as in the vertical direction V. The main longitudinal axis 411 thus has a vectorial component not equal to 0 in the longitudinal direction L and a vectorial component not equal to 0 in the vertical direction V. It results from this that the slot-shaped channel 41 in the lateral-side view of the midsole 1 extends from the base surface 2 in the vertical direction V as well as in the longitudinal direction L. It can furthermore be seen from FIG. 1 that the channels 41 are formed essentially mirror-symmetrically to their main longitudinal axis, i.e. the main longitudinal axis forms an axis of symmetry of the channel cross section in the V,L plane. The main longitudinal axis 411 of the channel 41 intersects the base surface 2 at the point of intersection S. The acute angle $\alpha$-41 between the main longitudinal axis 411 and the tangent abutting against the base surface 2 in the point S thereby is between 5° and 85°. In addition to main longitudinal axis 411, the channel 41 has a main lateral axis 412, which is arranged perpendicularly thereto and which likewise extends through the center point M of the channel 41. From the heel edge 5 towards the sole tip 6, the height, i.e. the distance of the channel walls of a channel from one another, decreases along the main lateral axis. The height along the main lateral axis of a channel 43 arranged in the forefoot area VFB is thereby smaller than the height along the main lateral axis of a channel 41, 42 arranged in the midfoot area MFB and/or in the heel area FB. The width of the channel 41 corresponds to the distance of the front and rear boundary of the channel 41 along the main longitudinal axis 411.

Figure 2A:
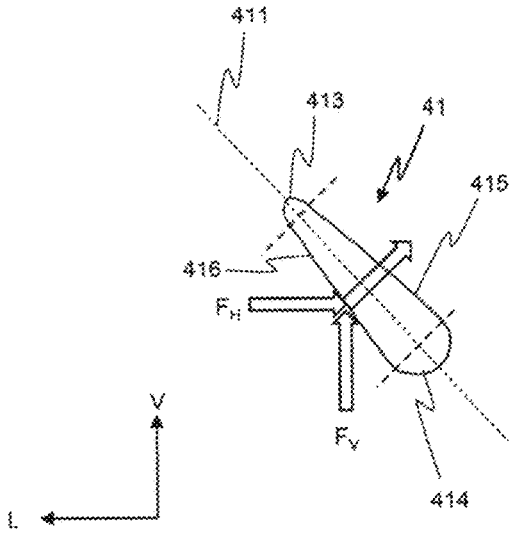
FIG. 2*a* shows a schematic illustration of a side view of a channel, which is drop-shaped in the V,L plane, as provided in embodiments of the sole according to the invention.
Figure 2B:
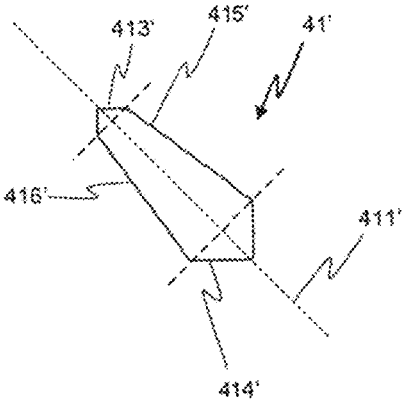
FIG. 2*b* shows a schematic illustration of a side view of a hexagonal channel, as provided in embodiments of the sole according to the invention.

An enlarged illustration of the channel 41 in the view along the transverse direction Q is illustrated in FIG. 2*a*. Channel 41 thereby has the front boundary 413 and the rear boundary 414. The dashed lines, which are arranged perpendicularly to the main longitudinal axis 4111, thereby show the boundaries of the front boundary 413 and of the rear boundary 414. As illustrated, the front and rear boundary is in each case formed in a curve-shaped or curved manner and is in particular formed concavely towards the channel center in the cross section in the V,L plane. Two flanks 415, 416, which are located opposite one another and which extend towards one another along the main longitudinal axis 411 and which are essentially formed linearly in the cross section along the V,L plane, extend between the front and the rear boundary 413, 414. The shape of the channel 41 along the V,L plane can thereby be described as drop shape, in particular as lancet-like shape. The drop-shaped contour essentially consists of an isosceles triangle, in this case with rounded tip, and a spherical segment, in this case a hemisphere. Due to the special formation of the channel with lateral openings, which narrow along the main longitudinal axis 411, a horizontal force FH, i.e. acting opposite to the longitudinal direction L, as well as a vertical force FV, i.e. acting in the vertical direction V, can be cushioned efficiently because this leads to a partial or complete closure of the lateral openings, in that the flanks 415 and 416 of the channel 41 move towards one another. A cushioning of horizontally acting forces can be effected thereby completely without segmentation of the midsole and even in the case of channels, which are formed completely by the midsole in the V,L plane. An alternative channel shape of a channel 41' is shown in FIG. 2*b*. Said channel likewise has a front boundary 413' and a rear boundary 414', which, in the present case, are not formed in a curved manner along the V,L plane but can be described by the legs of an isosceles triangle. The flanks 415' and 416', which are located opposite one another and which extend towards one another along the main longitudinal axis 411' from the rear boundary 414' to the front boundary 413' and which thus narrow the lateral opening of the channel 41', are arranged between the front and the rear boundary 413' and 414'.

Figure 3A:
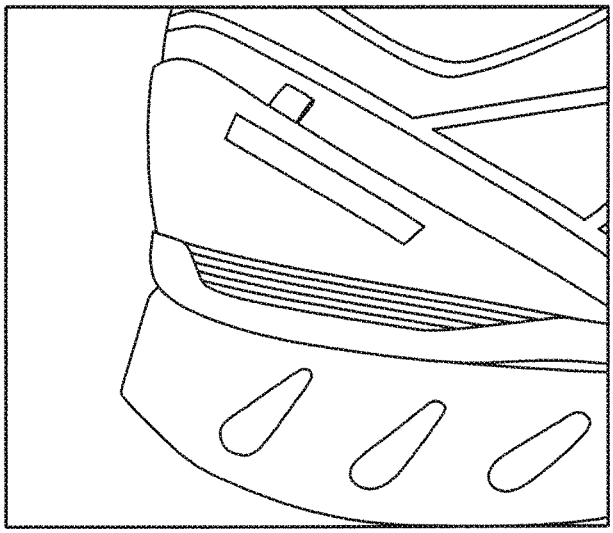
FIG. 3*a* shows a photograph of a heel area of a shoe comprising a sole according to the invention comprising drop-shaped channels in the unloaded.
Figure 3B:
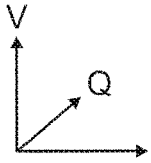
FIG. 3*b* shows a photograph of a heel area of a shoe comprising a sole according to the invention comprising drop-shaped channels in the loaded state.
Figure 3B:
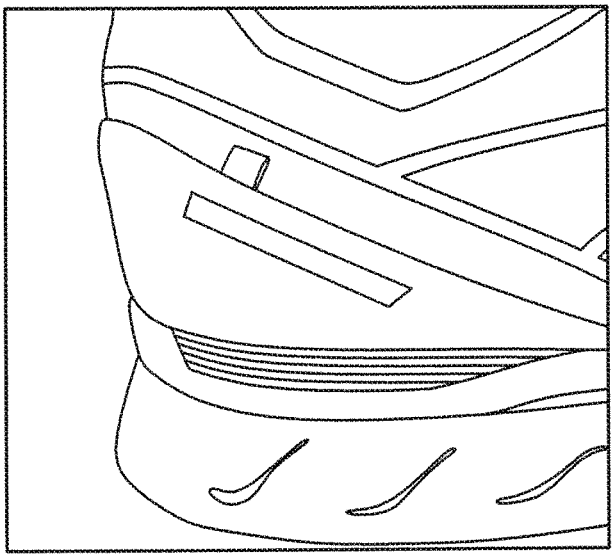

A running shoe comprising a midsole according to the invention in the unloaded state is illustrated in FIG. 3*a*. If the vertical and horizontal forces, which occur when running, now act on the midsole, this leads to a closure of the channels, which is essentially S-shaped, in particular directed in the longitudinal direction L. Forces occurring horizontally as well as vertically when running can be cushioned efficiently thereby.

Figure 4:
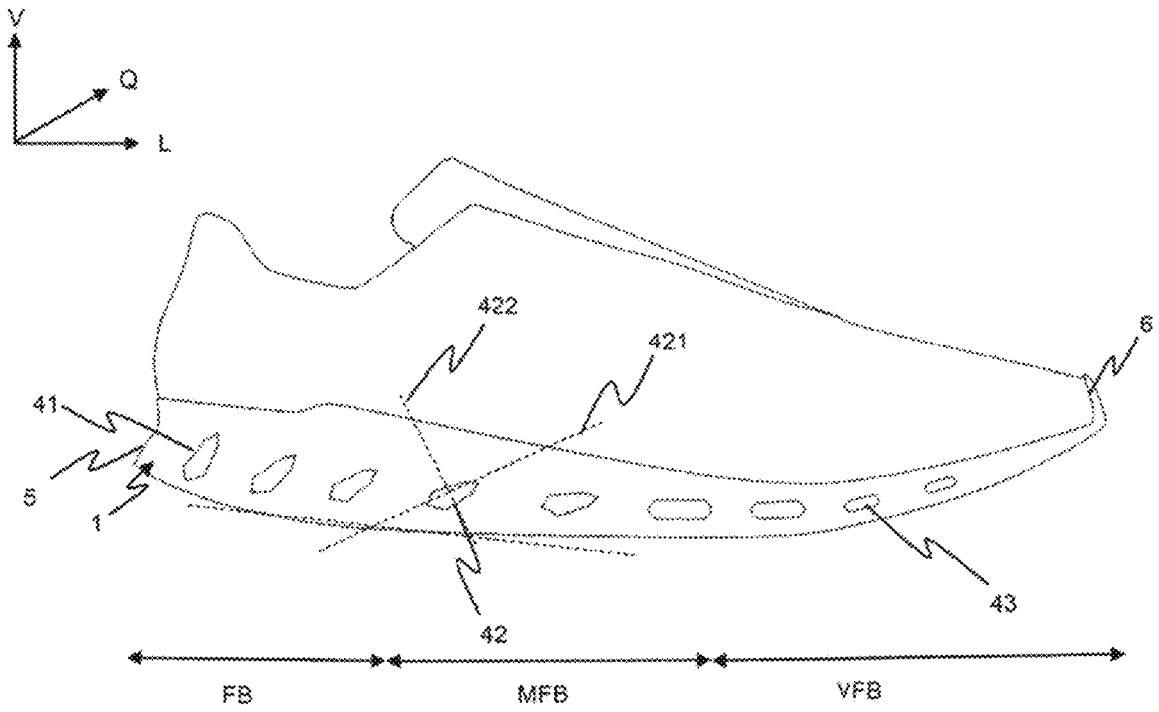
FIG. 4 schematically shows a side view of a running shoe comprising a sole according to a further embodiment of the invention.

A running shoe comprising a midsole 1 according to the invention according to a further embodiment of the invention is shown in FIG. 4. In contrast to the midsole of FIG. 1, the midsole 1 shown in FIG. 4 has channels 41 and 42 (for the sake of clarity, only a total of three channels are identified), which have a hexagonal contour in the cross section along the V,L plane, thus along the cross sectional plane in the longitudinal direction L of the midsole and perpendicularly to the transverse direction Q of the midsole, in the heel area FB and partially also in the midfoot area MFB. This contour is thereby an irregular hexagon. The main longitudinal axis 421 of the channel 42 extends through the center point of the channel 42 in the V,L plane and extends parallel to the longitudinal direction, i.e. the direction in which the channel extends. The main longitudinal axis additionally extends through the points of the channel walls, which are farthest away from one another in the cross section along the above-mentioned cross-sectional plane. The channels in the forefoot area and partially also channels in the midfoot area have a rectangular contour with rounded corners, as it is shown, e.g., for channel 43. These channels arranged in the forefoot area are thereby channels of the second type, i.e., the lateral openings thereof do not narrow along the respective main longitudinal axis from the rear boundary towards the front boundary because the two opposite flanks of such a channel extend parallel to one another in the longitudinal direction and to one another.

Figure 5A:
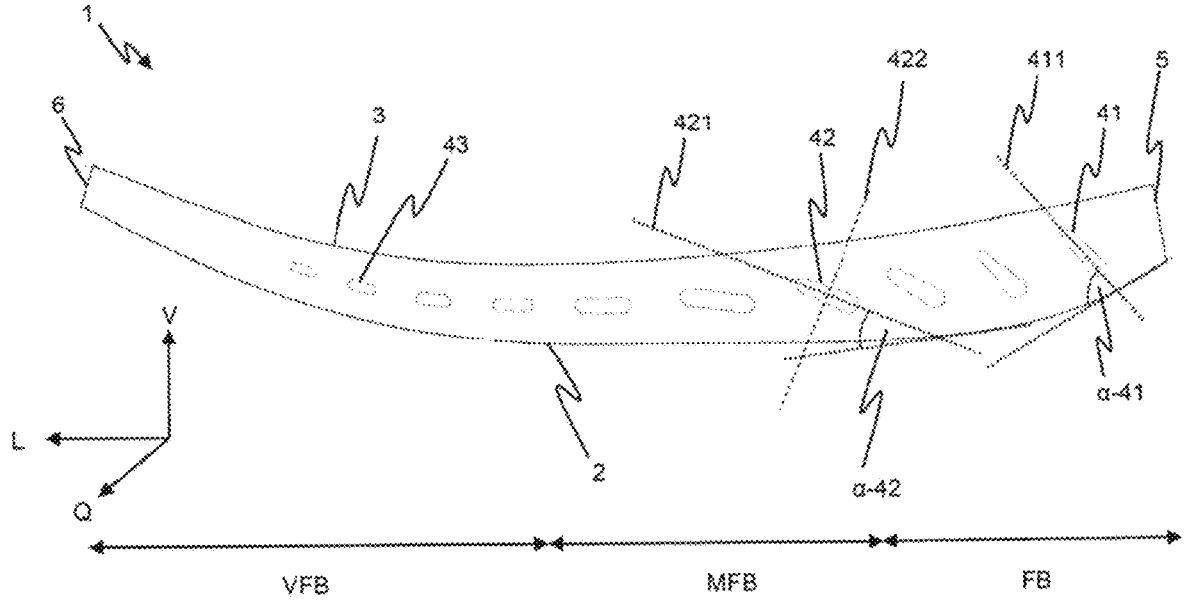
FIG. 5*a* shows a schematic side view of a sole according to the invention for a running shoe according to a further embodiment of the invention.

A further embodiment of a sole comprising midsole 1 is shown in FIG. 5*a*. The midsole 1 according to the present invention is delimited opposite to the vertical direction V by the base surface 2 and in the vertical direction V by the top surface 3. The midsole 1 is additionally divided into a heel area FB, a midfoot area MFB, and a forefoot area VFB. As illustrated, these three areas are arranged one after the other in the longitudinal direction, wherein the midfoot area MFB is arranged between the heel area FB and the forefoot area VFB. The midsole 1 comprises several channels 41, 42, 43 (for the sake of clarity, only three of the channels are identified), which extend in the transverse direction Q of the midsole 1 and which are arranged one behind the other in the longitudinal direction L of the midsole 1. These channels can generally be arranged essentially parallel to one another in the transverse direction Q. The channels 41, 42, 43 thereby each have an elongated contour in the cross section along a cross sectional plane in the longitudinal direction L of the midsole 1 and perpendicularly to the transverse direction Q of the midsole. In the shown coordinate system, this cross sectional plane is the V,L plane, each channel 41, 42, 43 in the cross section along the cross sectional plane in the longitudinal direction L and perpendicularly to the transverse direction Q has a main longitudinal axis 411, 421 (for the sake of clarity, only main longitudinal axes of two of the channels are illustrated). It can be seen thereby that the acute angle α-41 between the main longitudinal axis 411 and the base surface 2 or the tangent at the point of intersection of the main longitudinal axis 411 and the base surface 2, respectively, of the channel 41 arranged in the heel area FB is greater than the acute angle α-42 between the base surface 2 (or the tangent at the point of intersection of the main longitudinal axis 411 and the base surface 2, respectively) and the main longitudinal axis 421 of at least the channel 42 arranged in the midfoot area MFB. The angle between main longitudinal axis and base surface thereby becomes continuously smaller from channel to channel from the heel edge 5 towards the sole tip 6 all the way into the midfoot area and is essentially 0° in the forefoot area, i.e., the main longitudinal axis of the channels in the forefoot area VFB is parallel to the base surface 2. The channels in the heel area and partially channels of the midfoot area thereby represent channels of the first type, in the case of which the lateral openings narrow along the main longitudinal axis from the front boundary to the rear boundary. In the forefoot area, in contrast, the rectangular channels have flanks, which are arranged parallel to one another and which are additionally arranged parallel to the base surface 2. These channels thus represent channels of the second type. The channels additionally each have a main lateral axis 422 (for the sake of clarity, only the main lateral axis 422 of the channel 42 is illustrated), which is perpendicular to the main longitudinal axis and likewise intersects the channel center point. The height of a channel is defined as the distance of the channel walls of a channel along the main lateral axis. As shown in FIG. 1, the height along the main lateral axis of the channel 43 arranged in the forefoot area VFB is smaller than the height along the main lateral axis of a channel 41, 42 arranged in the midfoot area MFB and/or in the heel area FB. The channels in the forefoot area VFB thereby have a rectangular contour in the cross section along the cross-sectional plane in the longitudinal direction L of the midsole 1 and perpendicularly to the transverse direction Q of the midsole 1.

Figure 5B:
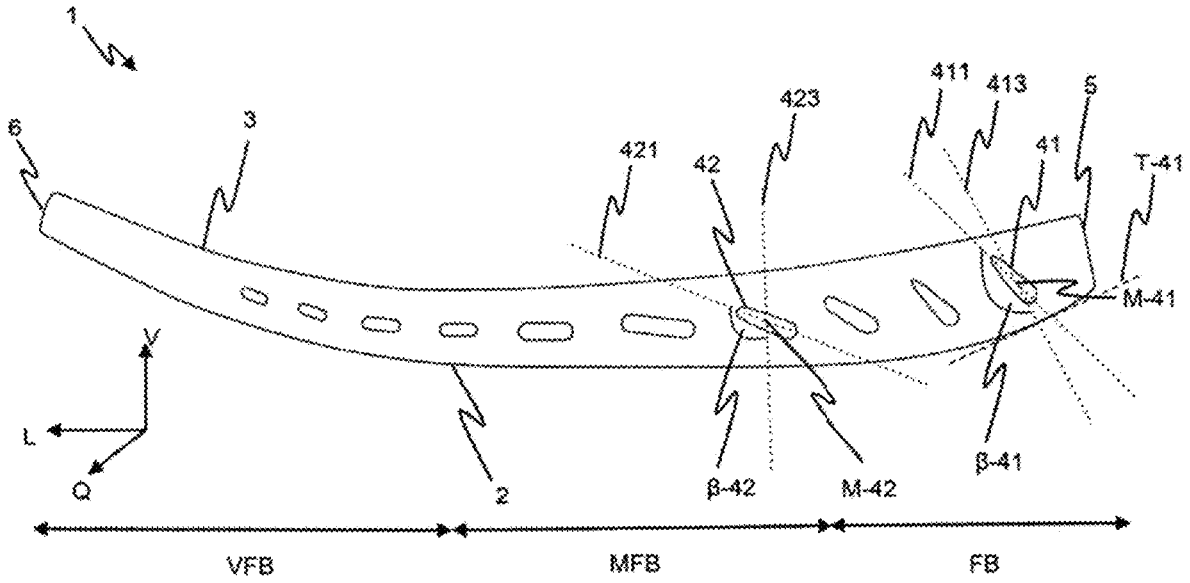
FIG. 5*b* shows a schematic side view of a sole according to the invention for a running shoe according to a further embodiment of the invention.

The embodiment of FIG. 5*a* is shown in FIG. 5*b*, instead of the acute angles α-41 and α-42 between the main longitudinal axis 411 and 421 and the base surface 2 or the tangent at the point of intersection of the main longitudinal axis 411 and 421 and the base surface 2, respectively, however, the obtuse angle β-41 between the main longitudinal axis 411 and the perpendicular channel line 413 of the channel 41 is illustrated. The perpendicular channel line thereby extends through the center point M-41 of the channel 41, which lies on the main longitudinal axis 411 and from which in particular the front and rear end, or the front and rear end area, respectively, of the channel 41 are spaced apart evenly. The perpendicular channel line is additionally perpendicular to the base surface 2 or to the tangent (see tangent T-41), which abuts with the base surface 2 against the base surface 2 in the point of intersection of the perpendicular channel line (see perpendicular channel line 413), respectively. The obtuse angle β-42 between the main longitudinal axis 421 of the channel 42 and the perpendicular channel line 423 of the channel 42 is shown in the same way. The obtuse angle β-41 of the channel 41, which is arranged in the heel area FB, is thereby greater than the obtuse angle β-42, which is arranged in the midfoot area MFB.

Figure 6:
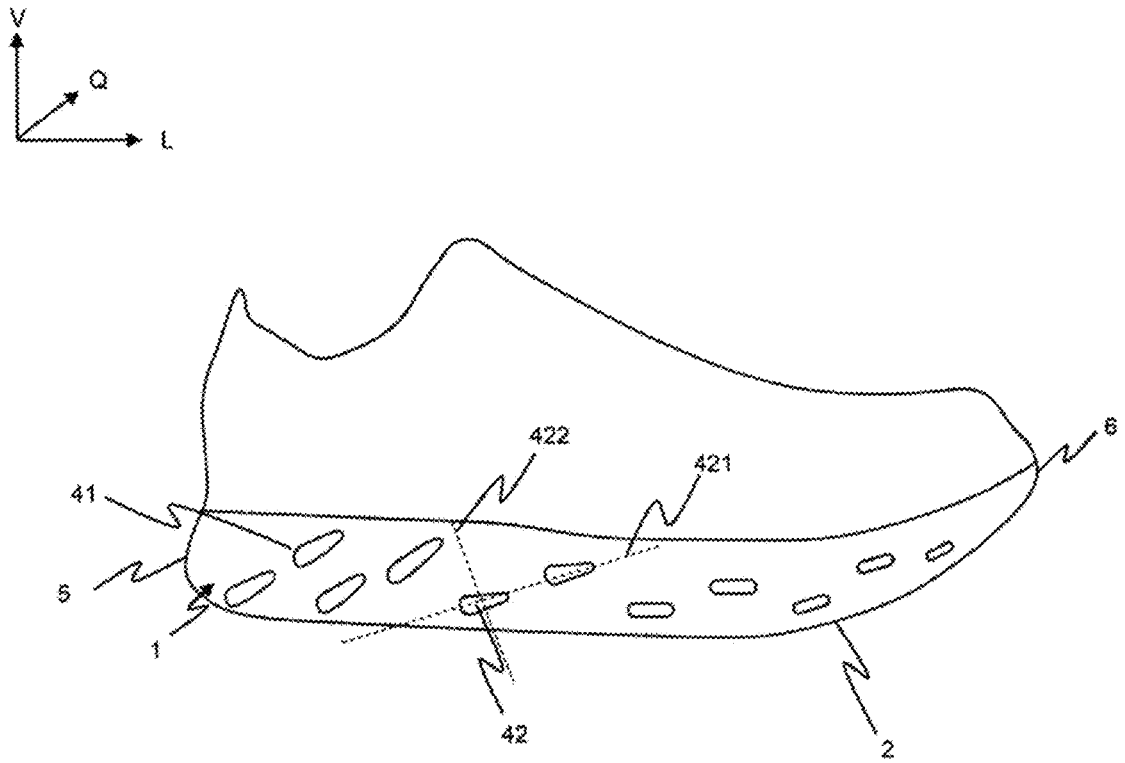
FIG. 6 shows a schematic side view of a shoe comprising a sole according to the invention for a running shoe according to a further embodiment of the invention.

A running shoe comprising a midsole 1 according to the invention according to a further embodiment of the invention is shown in FIG. 6. The main longitudinal axis 421 of the channel 42 extends through the center point of the channel 42 in the V,L plane and extends parallel to the longitudinal direction, i.e. the direction in which the channel extends. The main longitudinal axis additionally extends through the points of the channel walls, which are farthest away from one another in the cross section along the above-mentioned cross-sectional plane. The channels are thereby arranged one behind the other in the longitudinal direction L from the heel edge 5 to the sole tip 6 and are arranged in at least a first and a second horizontal plane in the lateral and/or medial area of the midsole 1. The first and second horizontal plane are thereby formed vertically offset from one another. The channel 41 is thereby arranged in the first horizontal plane, and the channel 42 is arranged in the second horizontal plane, which is arranged offset therefrom in the vertical direction.

The invention claimed is:

1. A sole for a running shoe comprising:

an elastic midsole (1), wherein the midsole (1) comprises several channels (41, 42, 43), which extend in a transverse direction (Q) of the midsole (1) and which are arranged one behind the other in a longitudinal direction (L) of the midsole (1), wherein the channels (41, 41', 42, 43) or at least a portion of the channels each comprise a lateral-side and/or medial-side opening in the midsole; and a front boundary and a rear boundary in the cross section along a cross sectional plane in the longitudinal direction (L) of the midsole (1) and perpendicularly to the transverse direction (Q) of the midsole (1), as well as a main longitudinal axis (411, 411', 421), along which the channels (41, 41, 42, 43) each extend in a slot-shaped manner from their respective rear boundary to their respective front boundary in such a way that the lateral-side and/or medial-side opening of the channels narrows along the main longitudinal axis (411, 411') from the rear boundary (414, 414') to the front boundary (413, 413');

wherein at least some of the channels are arranged in a heel area (FB) and include a drop-shaped contour along the cross sectional plane in the longitudinal direction (L) of the midsole (1) and perpendicular to the transverse direction (Q) of the midsole (1), wherein the drop-shaped contour comprises an isosceles triangle having two legs and a base, and the drop-shaped contour further comprises a circular segment connected to the base of the isosceles triangle, wherein the circular segment of the drop shape is arranged closer to a base surface of the midsole and closer to a heel edge of the midsole than the isosceles triangle of the respective drop shape, and wherein the isosceles triangle of the respective drop shape is arranged closer to a top surface of the midsole and closer to a sole tip of the midsole than the circular segment of the respective drop shape.

2. The sole according to claim 1, wherein the channels (41, 41', 42, 43) are each arranged in such a way that the respective main longitudinal axis (411, 411', 421) of the channels (41, 41', 42, 43) has a component in a vertical direction (V) of the midsole (1) and a component in the longitudinal direction (L).

3. The sole according to claim 1, wherein the channels (41, 41', 42, 43) are formed essentially mirror-symmetrically about the respective main longitudinal axis (411, 411', 421), in each case along the cross-sectional plane in the longitudinal direction (L) of the midsole (1) and perpendicularly to the transverse direction (Q) of the midsole (1).

4. The sole according to claim 1, wherein the channels (41, 41', 42, 43) each have two flanks (415, 416, 415', 416'), which are located opposite one another and which extend towards one another in a direction of the main longitudinal axis (411, 411', 421).

5. The sole according to claim 1, wherein the midsole has the base surface (2) delimiting the midsole (1) opposite to the vertical direction (V) of the midsole, and the top surface (3) delimiting the midsole (1) in the vertical direction (V), and wherein the main longitudinal axis (411, 411', 421') of the respective channels (41, 41', 42, 43) intersects the base surface (2) and/or a tangent abutting against it at an acute angle of 5° to 85.

6. The sole according to claim 1, wherein the channels (41, 41', 42, 43) are configured to completely close their side opening by means of the forces occurring when running.

7. The sole according to claim 1, wherein the midsole (1) is divided into a heel area (FB), a forefoot area (VFB), and a midfoot area (MFB), which is arranged between the heel area and the forefoot area, and wherein the channels (41, 42) are arranged at least in the heel area and/or in the midfoot area.

8. The sole according to claim 7, wherein an acute angle (α-41) between the main longitudinal axis (411) and the base surface (2) of at least one channel (41) arranged in the heel area is greater than an acute angle (a-42) between the base surface (2) and the main longitudinal axis (421) of at least one channel (42, 43) arranged in the midfoot area (MFB) and/or in the forefoot area (VFB).

9. The sole according to claim 8, wherein the acute angle (α-41) between the main longitudinal axis (411) and the base surface (2) becomes smaller from the channel (41) arranged closest to the heel edge (5) of the midsole (1) to the sole tip (6).

10. The sole according to claim 7, wherein the midsole (1) additionally has channels (43) in the forefoot area (VFB), which have an essentially rectangular contour along the cross sectional plane in the longitudinal direction (L) of the midsole (1) and perpendicularly to the transverse direction (Q) of the midsole.

11. The sole according to claim 7, wherein the acute angle between the main longitudinal axis and the base surface (2) of at least one channel (43) arranged in the forefoot area (VFB) is between 0° to 5°.

12. The sole according to claim 11, wherein the main longitudinal axis of at least one channel (43) arranged in the forefoot area (VFB) is arranged essentially parallel to the base surface.

13. The sole according to claim 7, wherein the acute angle (a-42) between the main longitudinal axis (421) and the base surface (2) of a channel (42) arranged in the midfoot area (MFB) is between 0° and 35°.

14. The sole according to claim 1, wherein each channel (41, 42, 43) has a main lateral axis (412, 422), and wherein the height along the main lateral axis (412, 422) of a channel (43) arranged in a forefoot area (VFB) is smaller than the height along the main lateral axis (422) of a channel (41, 42) arranged in a midfoot area (MFB) and/or in the heel area (FB).

15. The sole according to claim 1, wherein the channels (41, 41', 42, 43) each have a height of 0.1 cm to 1.5 cm along the main lateral axis (412, 422).

16. The sole according to claim 1, wherein the channels (41, 41', 42, 43) each have a width of 0.5 cm to 3 cm along the main longitudinal axis (411, 411', 421).

17. The sole according to claim 1, wherein the midsole has the base surface (2) delimiting the midsole (1) opposite to the vertical direction (V) of the midsole, and the top surface (3) delimiting the midsole (1) in the vertical direction (V), and wherein the main longitudinal axis (411, 411', 421') of the respective channels (41, 41', 42, 43) intersects the base surface (2) and/or a tangent abutting against the base surface at an acute angle of 40° to 75°.

18. A running shoe, comprising the sole according to claim 1.

* * * * *